US008201970B2

(12) United States Patent
Wang et al.

(10) Patent No.: US 8,201,970 B2
(45) Date of Patent: Jun. 19, 2012

(54) LED LAMP HAVING IMPROVED WATERPROOF PERFORMANCE

(75) Inventors: Zhong-Qing Wang, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 261 days.

(21) Appl. No.: 12/642,872

(22) Filed: Dec. 21, 2009

(65) Prior Publication Data

US 2011/0090692 A1 Apr. 21, 2011

(30) Foreign Application Priority Data

Oct. 15, 2009 (CN) ..... 2009 1 0308309

(51) Int. Cl.
*F21S 4/00* (2006.01)

(52) U.S. Cl. ..... 362/249.02; 362/249.01

(58) Field of Classification Search ..... 362/249.02, 362/249.01, 267
See application file for complete search history.

(56) References Cited

U.S. PATENT DOCUMENTS

| | | | | |
|---|---|---|---|---|
| 7,125,146 | B2 * | 10/2006 | Willis et al. | 362/267 |
| 7,293,898 | B2 * | 11/2007 | Kumthampinij et al. | 362/294 |
| 2003/0026085 | A1 * | 2/2003 | Ueda et al. | 362/31 |
| 2006/0187652 | A1 * | 8/2006 | Doyle | 362/96 |
| 2009/0103307 | A1 * | 4/2009 | Shu | 362/294 |
| 2009/0201672 | A1 * | 8/2009 | Lee | 362/108 |

* cited by examiner

*Primary Examiner* — Evan Dzierzynski
(74) *Attorney, Agent, or Firm* — Altis Law Group, Inc.

(57) ABSTRACT

An LED lamp includes a lamp seat, an illuminant module mounted on the lamp seat, an envelope covering the illuminant module, a waterproof cushion sandwiched between the lamp seat and the envelope and a pressing frame pressing the envelope toward the lamp seat. A plurality of protrusions protrude vertically and downwardly from the pressing frame. Outer faces of sidewalls of the lamp seat slant outwardly and upwardly relative to each other. A plurality of fasteners extend through the protrusions horizontally and are fastened on the sidewalls of the lamp seat, whereby the envelope is urged to tightly press the waterproof cushion toward the lamp seat.

14 Claims, 3 Drawing Sheets

LED LAMP HAVING IMPROVED WATERPROOF PERFORMANCE

BACKGROUND

1. Technical Field

The disclosure relates to illumination devices and, particularly, to an LED (light-emitting diode) lamp with good waterproof performance.

2. Description of Related Art

LED lamps which are applied outdoors commonly have demand of good waterproof performance. However, the waterproof performance of conventional LED lamps is very weak, and water can easily enter into chambers of the conventional LED lamps, which results in that light sources and printed circuit boards in the chambers of the conventional LED lamps break down or can not work normally.

What is needed, therefore, is an LED lamp which can overcome the described limitations.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
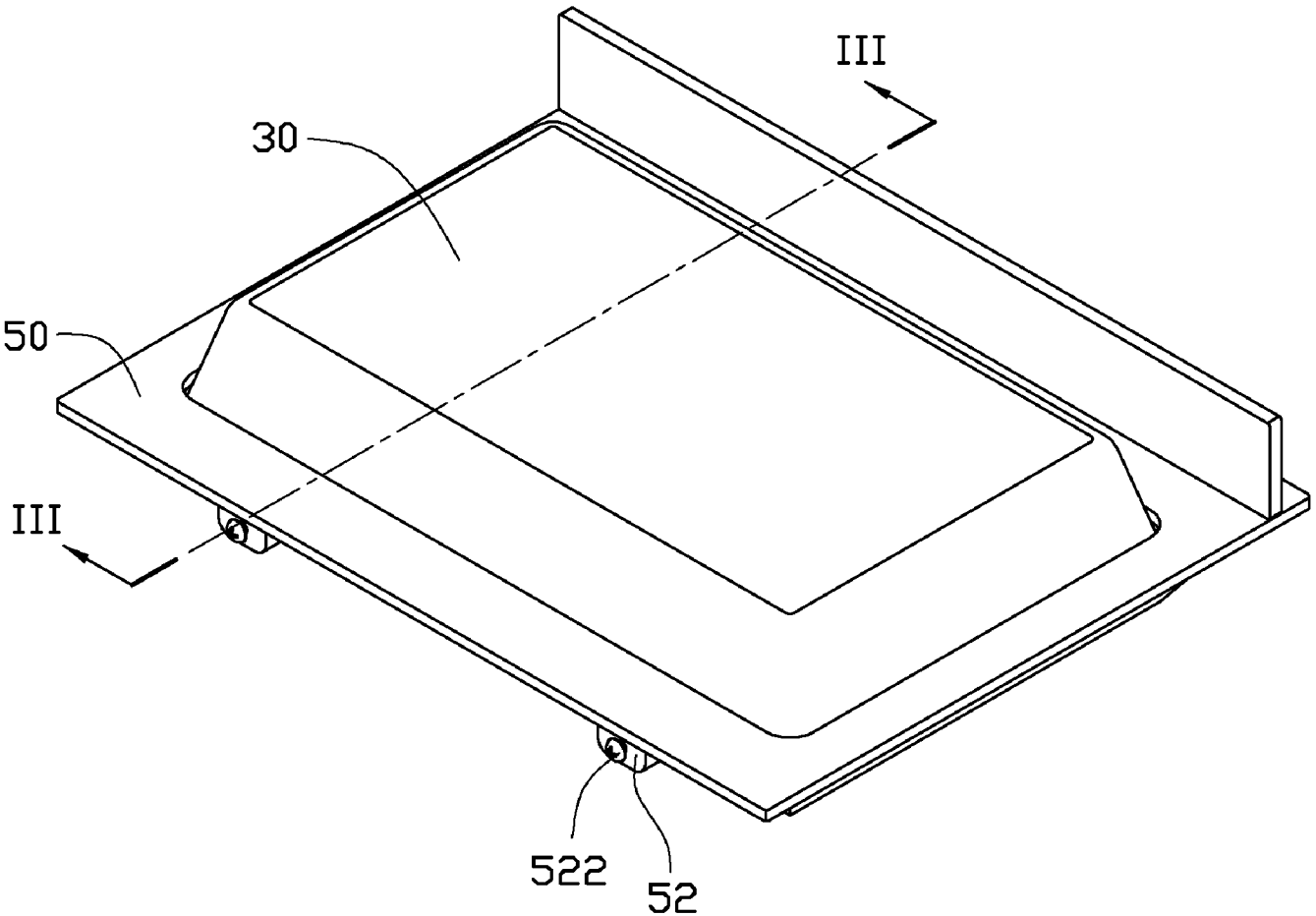
FIG. 1 is an isometric, assembled view of an LED lamp in accordance with an embodiment of the disclosure.
Figure 2:
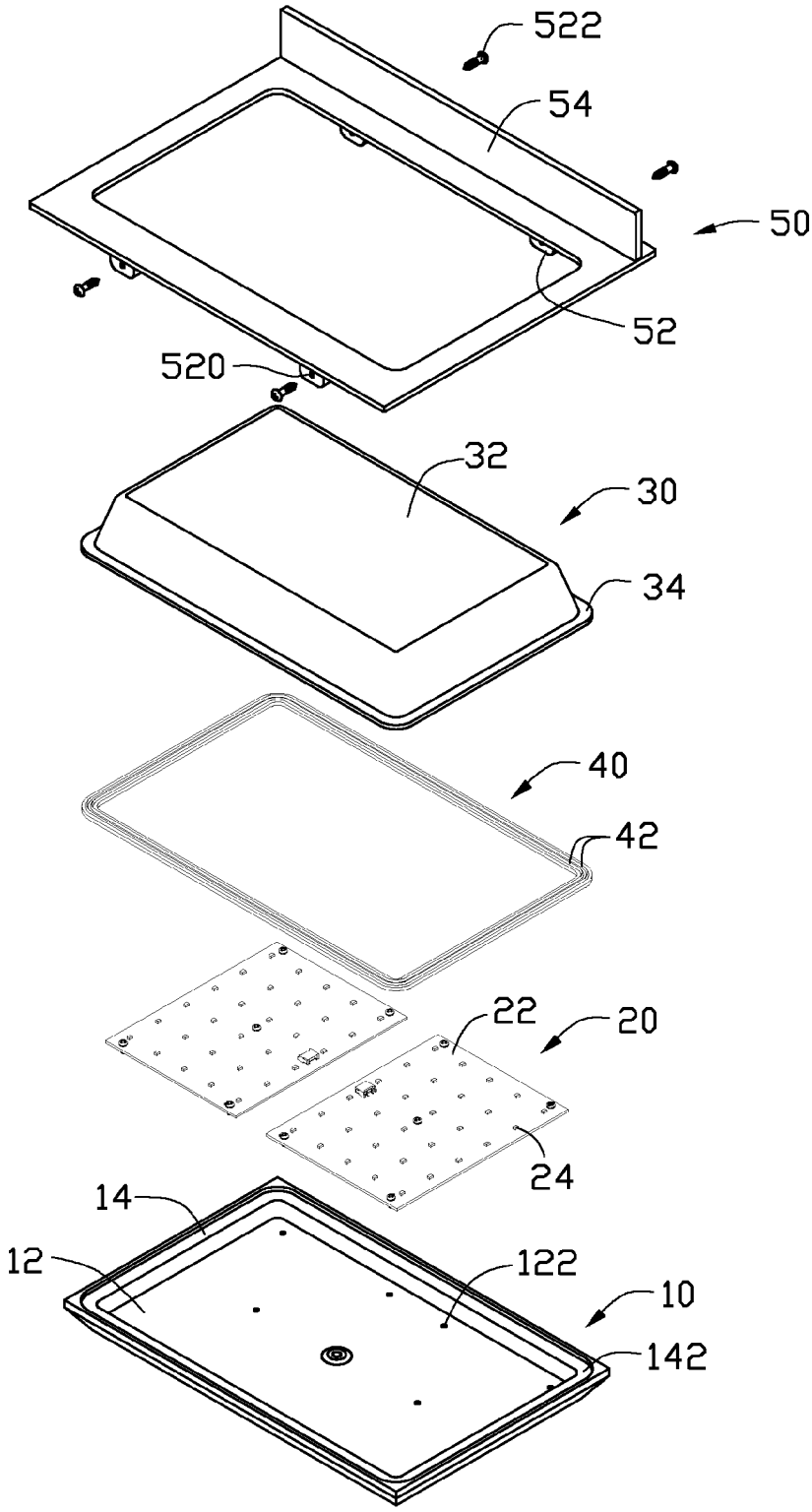
FIG. 2 is an isometric, exploded view of the LED lamp of FIG. 1.

Referring to FIGS. 1-2, an LED lamp in accordance with an embodiment of the disclosure can be applied outdoors for illumination and has good waterproof performance. The lamp includes a lamp seat 10, two illuminant modules 20 adhered on an inner side of the lamp seat 10, a transparent envelope 30 covering the illuminant modules 20, a waterproof cushion 40 sandwiched between the lamp seat 10 and the envelope 30, and a pressing frame 50 surrounding the envelope 30 and connecting with the lamp seat 10.

The lamp seat 10 is made of metal such as aluminum, copper or an alloy thereof and includes a rectangular base 12 and four sidewalls 14 slantwise and upwardly extending from an outer edge of the base 12. The lamp seat 10 has a trapezoidal cross section and is generally U-shaped, and outer faces of the sidewalls 14 slant outwardly relative to each other. The sidewalls 14 and the base 12 together define a receiving room thereamong for receiving the illuminant modules 20 therein. Inner edges of tops of the sidewalls 14 recess downwardly and form a looped groove 142 for receiving the waterproof cushion 40 therein. The base 12 define a plurality of fixing holes 122 in an inner face thereof for engaging with screws which extend through the illuminant modules 20, to fasten the illuminant modules 20 on the base 12. Four supporting feet 124 extend downwardly from four corners of an outer face of the base 12 for supporting the lamp on an intended place.

The illuminant modules 20 each include a rectangular printed circuit board 22 and a plurality of LEDs 24 mounted on a side face of the printed circuit board 22. Another side face of the printed circuit board 22 is adhered on and thermally contacts the base 12 of the lamp seat 10. The printed circuit board 22 defines a plurality of through holes (not labeled), corresponding to the fixing holes 122 of the base 12.

Figure 3:
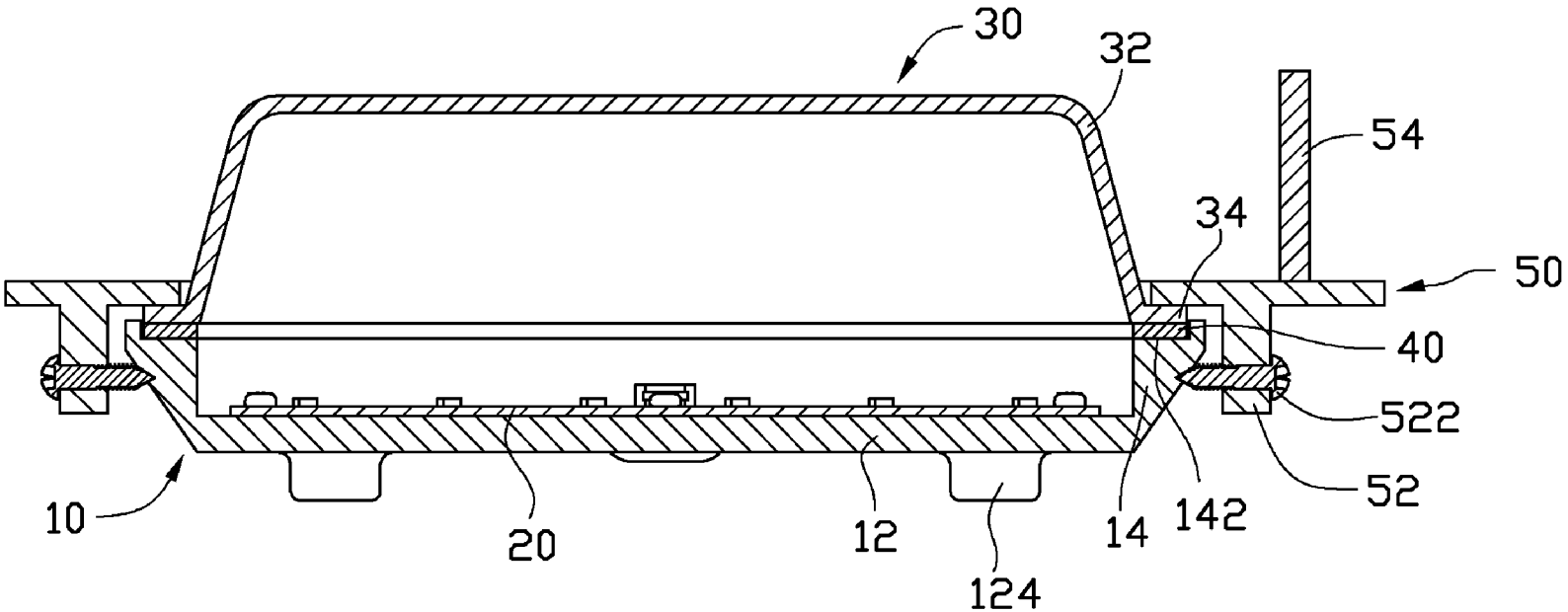
FIG. 3 is a cross-sectional view of the LED lamp of FIG. 1, taken along a line III-III thereof.

Also referring to FIG. 3, the waterproof cushion 40 is made of resilient material such as rubber. The waterproof cushion 40 has a rectangular, loop-shaped structure with four sides. Two spaced loop-shaped bulges 42 protrude upwardly from a top face of the waterproof cushion 40.

The envelope 30 can be made of glass, polycarbonate (PC), polymethyl methacrylate (PMMA) or other suitable material. The envelope 30 includes a body 32 and a flange 34 extending horizontally and outwardly from a bottom periphery of the body 32. The body 32 of the envelope 30 has a trapezoidal cross section and is generally inverted U-shaped. The flange 34 of the envelope 30 has a size equal to that of the waterproof cushion 40, so that the flange 34 can fitly cover the waterproof cushion 40. Furthermore, a lower portion of the flange 34 of the envelope 30 can be received in the groove 142 of the lamp seat 10 when the envelope 30, the waterproof cushion 40 and the lamp seat 10 are assembled together, whereby the lamp seat 10, the waterproof cushion 40 and the envelope 30 together form a sealed casing for preventing rain and dust from entering into the LED lamp.

The pressing frame 50 is substantially rectangular, loop-shaped and is provided for securely connect the envelope 30 and the waterproof cushion 40 to the lamp seat 10. A through hole in a center of the pressing frame 50 is rectangular and has a size larger than that of the body 32 of the envelope 30 but smaller than that of the flange 34 of the envelope 30, so that the body 32 of the envelope 30 can extend through the pressing frame 50, and the flange 34 of the envelope 30 can be pressed by the pressing frame 50 toward the lamp seat 10. A baffle plate 54 extends upwardly from a top of a long side of the pressing frame 50. Two pairs of protrusions 52 protrude vertically and downwardly from bottoms of two long sides of the pressing frame 50 near four corners thereof. An interval between the protrusions 52 of each pair of the protrusions 52 along a width direction of the pressing frame 50 is larger than a length of a short sidewall 14 of the lamp seat 10 (shown in FIG. 3). Each protrusion 52 defines a threaded hole 520 along the horizontal direction for engagingly receiving a screw 522 therein, which acts as a fastener.

In assembly, screws (not shown) extend through the through holes of the printed circuit boards 22 and are screwed into the fixing holes 122 of the base 12 to fix the illuminant modules 20 on the base 12 of the lamp seat 10. The waterproof cushion 40 is disposed in the groove 142 of the lamp seat 10. The envelope 30 is disposed on the waterproof cushion 40, and the flange 34 of the envelope 30 contacts the elastic bulges 42 of the waterproof cushion 40. The pressing frame 50 is sleeved on the envelope 30 and presses the flange 34 of the envelope 30 toward the lamp seat 10. The screws 522 are driven to screw into the threaded holes 520 of the pressing frame 50. Tips of the screws 522 are urged to move downwardly along the inclined outer faces of two long sidewalls 14 of the lamp seat 10 when the tips of the screws 522 contact the inclined outer faces of the two long sidewalls 14 of the lamp seat 10, bringing the pressing frame 50 to press the envelope 30 downwardly, and bringing the envelope 30 to press the waterproof cushion 40 downwardly, till the waterproof cushion 40 can not be compressed further. Further rotation of the screws 522 causes the screws 522 to be screwed into the inclined outer faces of the long sidewalls 14 of the lamp seat 10 at specific points thereof, thus all parts of the LED lamp are securely assembled together.

According to the disclosure, due to an inclined angle of the inclined outer faces of the sidewalls 14 relative to the screws 522, the envelope 30 can be urged to press the waterproof cushion 40 downwardly and intimately during the period when the screws 522 are firstly moved on and then screwed into the sidewalls 14 of the lamp seat 10; thus, good waterproof performance of the LED lamp is achieved.

It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. An LED lamp comprising:

a lamp seat having outer faces of sidewalls thereof slanting outwardly and upwardly relative to each other;

an illuminant module contained in the lamp seat, the illuminant module comprising a plurality of LEDs;

an envelope covering the illuminant module and sealing the illuminant module in the lamp seat;

a waterproof cushion sandwiched between the lamp seat and the envelope;

a pressing frame pressing the envelope toward the lamp seat whereby the waterproof cushion is tightly sandwiched between the lamp seat and the envelope, the pressing frame having a plurality of protrusions located beside the outer faces of the sidewalls of the lamp seat;

a plurality of fasteners extending through the protrusions to be fastened to the sidewalls of the lamp seat, and bringing the envelope to press the waterproof cushion toward the lamp seat;

wherein the lamp seat comprises a base, the outer faces of the sidewalls of the lamp seat extending slantwise from an outer edge of the base, the sidewalls and the base together defining a receiving room thereamong, the illuminant module being received in the receiving room; and wherein the illuminant module is fastened on the base, the waterproof cushion being sandwiched between the envelope and inner edges of tops of the sidewalls.

2. The LED lamp as claimed in claim 1, wherein the inner edges of the tops of the sidewalls recess downwardly to form a groove, and the waterproof cushion is received in the groove.

3. The LED lamp as claimed in claim 2, wherein an elastic loop-shaped bulge protrudes upwardly from the waterproof cushion towards the envelope.

4. The LED lamp as claimed in claim 3, wherein the envelope comprises a body and a flange extending outwardly from a bottom periphery of the body, and the flange of the envelope contacts the elastic bulge of the waterproof cushion.

5. The LED lamp as claimed in claim 4, wherein the pressing frame is loop-shaped, and the pressing frame is sleeved on the envelope and presses the flange of the envelope toward the lamp seat.

6. The LED lamp as claimed in claim 1, wherein a plurality of supporting feet extend downwardly from a periphery of an outer face of the base for supporting the lamp on an intended place.

7. The LED lamp as claimed in claim 1, wherein the lamp seat is made of metal, and the illuminant module thermally contacts the lamp seat.

8. The LED lamp as claimed in claim 1, wherein the illuminant module comprises a printed circuit board and the plurality of LEDs is mounted on a side face of the printed circuit board, and another side face of the printed circuit board is adhered on an inner side of the lamp seat.

9. The LED lamp as claimed in claim 1, wherein the fasteners are screws, and each protrusion defines a threaded hole for engagingly receiving a corresponding screw therein.

10. An LED lamp comprising:

a lamp seat comprising a base and a plurality of sidewalls slantwise extending from an outer edge of the base, the sidewalls and the base together defining a receiving room, outer faces of the sidewalls of the lamp seat slanting outwardly and upwardly relative to each other;

an illuminant module being received in the receiving room and mounted on the base of the lamp seat, the illuminant module comprising a plurality of LEDs;

an envelope covering the illuminant module and sealing the illuminant module in the lamp seat;

a waterproof cushion sandwiched between the sidewalls of the lamp seat and the envelope;

a pressing frame pressing the envelope toward the lamp seat; and a plurality of fasteners extending through the pressing frame to be fastened to the sidewalls of the lamp seat, and bringing the envelope to tightly press the waterproof cushion toward the lamp seat;

wherein inner edges of tops of the sidewalls recess downwardly and thereby form a groove, and the waterproof cushion is received in the groove; and wherein an elastic loop-shaped bulge protrudes upwardly from the waterproof cushion towards the envelope.

11. The LED lamp as claimed in claim 10, wherein a plurality of protrusions protrude from the pressing frame towards positions beside the outer faces of the sidewalls of the lamp seat, the fasteners extending through the protrusions, respectively.

12. The LED lamp as claimed in claim 10, wherein the envelope comprises a body and a flange extending outwardly from a bottom periphery of the body, and the flange of the envelope contacts the elastic bulge of the waterproof cushion.

13. The LED lamp as claimed in claim 12, wherein the pressing frame is loop-shaped, and the pressing frame is sleeved on the envelope and presses the flange of the envelope toward the lamp seat.

14. The LED lamp as claimed in claim 10, wherein the illuminant module comprises a printed circuit board and the plurality of LEDs is mounted on a side face of the printed circuit board, and another side face of the printed circuit board is adhered on the base of the lamp seat.

* * * * *